US010483684B2

(12) United States Patent
Knight et al.

(10) Patent No.: US 10,483,684 B2
(45) Date of Patent: Nov. 19, 2019

(54) HOUSING FOR A USB CONNECTOR PLUG

(71) Applicant: UCB Biopharma SPRL, Brussels (BE)

(72) Inventors: Barry Alan Knight, Slough (GB); Oliver Frederik Stumpp, Bulle (CH)

(73) Assignee: UCB BIOPHARMA SPRL, Brussels (BE)

( * ) Notice: Subject to any disclaimer, the term of this patent is extended or adjusted under 35 U.S.C. 154(b) by 0 days.

(21) Appl. No.: 15/777,483

(22) PCT Filed: Nov. 17, 2016

(86) PCT No.: PCT/EP2016/078063
§ 371 (c)(1),
(2) Date: May 18, 2018

(87) PCT Pub. No.: WO2017/085216
PCT Pub. Date: May 26, 2017

(65) Prior Publication Data

US 2018/0337485 A1 Nov. 22, 2018

(30) Foreign Application Priority Data

Nov. 20, 2015 (GB) ..... 1520505.7

(51) Int. Cl.
*H01R 13/00* (2006.01)
*H01R 13/516* (2006.01)
*H01R 13/62* (2006.01)

(52) U.S. Cl.
CPC ..... *H01R 13/516* (2013.01); *H01R 13/62* (2013.01)

(58) Field of Classification Search
CPC ..... H01R 13/502; H01R 13/516; H01R 13/5845; H01R 13/6335
USPC ..... 439/465, 470, 476.1, 481
See application file for complete search history.

(56) References Cited

U.S. PATENT DOCUMENTS 5,801,918 A * 9/1998 Ahearn ..... G06K 7/10881 235/472.01
5,938,476 A * 8/1999 Wu ..... H01R 13/6581 439/607.57
7,172,451 B1 * 2/2007 Ratzlaff ..... H01R 13/639 439/106
7,347,708 B1 * 3/2008 Huang ..... H01R 13/639 439/263
7,422,488 B1 * 9/2008 Wu ..... H01R 13/6597 439/676

(Continued)

FOREIGN PATENT DOCUMENTS

WO WO2014030903 A1 2/2014

*Primary Examiner* — Hae Moon Hyeon
(74) *Attorney, Agent, or Firm* — Muncy, Geissler, Olds & Lowe, PC

(57) ABSTRACT

A housing for a USB connector plug includes a body for partly surrounding the USB connector plug. The body defines a forward aperture from which a plug head of the USB connector plug extends and a rearward aperture from which a cable of the USB connector plug extends. The body has an outer form, which defines on a first surface thereof, a thumb pad and on a second opposing surface, a finger pad. The outer form of the body is provided with a thumb push element that stands proud from a forward part of the thumb pad. The housing is configured as an over-housing for a conventional USB connector plug.

14 Claims, 7 Drawing Sheets

(56) References Cited

U.S. PATENT DOCUMENTS

| | | | | |
|---|---|---|---|---|
| 7,455,545 | B2 * | 11/2008 | Chawgo | H01R 13/6275 439/352 |
| 7,632,155 | B1 * | 12/2009 | Wu | H01R 9/035 439/497 |
| 8,062,050 | B2 * | 11/2011 | Wu | H01R 13/6582 439/350 |
| 8,435,067 | B2 * | 5/2013 | Wegener | H01R 13/5833 439/445 |
| 9,276,330 | B2 * | 3/2016 | Wu | H01R 12/775 |
| 2003/0157836 | A1 * | 8/2003 | Morikawa | H01R 13/6275 439/607.41 |
| 2005/0197011 | A1 | 9/2005 | Tsai | |
| 2009/0047821 | A1 * | 2/2009 | Chen | H01R 13/6275 439/358 |
| 2009/0246998 | A1 * | 10/2009 | Wu | H01R 9/032 439/352 |
| 2010/0330837 | A1 * | 12/2010 | Wegener | H01R 13/5833 439/456 |
| 2011/0130045 | A1 * | 6/2011 | Su | H01R 4/5033 439/660 |
| 2013/0267101 | A1 * | 10/2013 | Furness | H01R 13/6205 439/39 |
| 2013/0308304 | A1 * | 11/2013 | Tuchrelo | H01R 13/7175 362/157 |
| 2014/0342597 | A1 * | 11/2014 | Albert | H01R 24/40 439/476.1 |
| 2016/0218459 | A1 * | 7/2016 | Hung | H01R 13/502 |
| 2019/0006791 | A1 * | 1/2019 | Holley | H01R 13/506 |
| 2019/0097348 | A1 * | 3/2019 | Drost | H01R 13/6335 |

* cited by examiner

HOUSING FOR A USB CONNECTOR PLUG

BACKGROUND OF THE INVENTION

Field of the Invention

The present invention relates to a housing for a USB connector plug.

Description of Related Art

USB connector plugs are well-known in the technology industry. USB (Universal Serial Bus) is an industry standard that defines the cables, connectors and communications protocol used for connecting, communicating, and power supply between computers and electronic devices such as keyboards, digital cameras, portable media players, disk drives and network adapters. It has also become commonplace on other devices, such as Internet-enabled mobile phones ('smartphones'), personal digital assistants and video game consoles.

The USB connector plug is formed of metal and has a standard shape, which is generally of flattened, rectangular ('male') form and arranged for receipt by a USB socket of corresponding ('female') shape. A housing is provided for the USB connector plug, and is arranged such that the ('male') head of the plug protrudes from a forward part of housing, and a cable extends from a rearward part of the housing. The housing thus, generally provides a sleeve that locates between the metal plug and the cable. The housing typically has a flattened, rectangular outer form, which generally mirrors that of the metal plug. When plugging the ('male') connector into a ('female') socket, a user typically grips the flattened, rectangular form housing between thumb and first finger, and guides the plug into the socket.

The operation of 'plugging in' of a USB connector plug into a socket can be challenging for those with impaired manual dexterity, including those who have arthritis or other health impairment, which affects thumb and finger action. In particular, conventional USB connector housing forms can be difficult to grip and to guide into 'plugged-in' position at a socket. Similarly, difficulty with gripping of the USB connector plug housing may be faced when conducting the operation of pulling a USB connector plug out from a socket.

BRIEF SUMMARY OF THE INVENTION

Applicant has now found that the ability of a user to grip a USB connector plug may be improved by adopting the form of connector plug housing as described herein, thereby improving utility for users, particularly those of impaired manual dexterity during 'plugging in' and 'unplugging' operations.

According to one aspect of the present invention there is provided a housing for a USB connector plug comprising a body for partly surrounding said USB connector plug, said body defining a forward aperture from which a plug head of the USB connector plug extends and a rearward aperture from which a cable of the USB connector plug extends, the body having an outer form, which defines on a first surface thereof, a thumb pad and on a second opposing surface, a finger pad, wherein said outer form of the body is provided with a thumb push element that stands proud from a forward part of said thumb pad.

These and other embodiments of the present invention are set forth in the later description, which describes for illustrative purposes only various embodiments thereof.

In relation to aspects of the housing for a USB connector plug described herein the term 'forward' is used to mean that end of the housing from which the USB connector plug head extends, and which locates closest to the socket in 'plugged in' use and the term 'rear' or 'rearward' is used to mean that end of the housing from which the cable of the USB connector plug extends, and which locates furthest from the socket in 'plugged in' use.

There is provided a housing for a USB connector plug. The USB connector plug itself, is generally formed of metal and has a standard shape, which is conventionally of flattened, rectangular ('male') form and arranged for receipt by a USB socket of corresponding ('female') shape. The USB connector plug is provided with a cable.

In embodiments, the housing herein, is suitable for use with all three basic kinds or sizes of USB connector plugs: The older "standard" size, in its USB 1.1, 2.0, and 3.0 variants, the "mini" size and the "micro" size, in its USB 1.1, 2.0, and 3.0 variants. In accord with the USB standard, there are also Type-A or Type-B connector plugs.

The housing comprises a body for partly surrounding the USB connector plug. The body defines a forward aperture from which a plug head of the USB connector plug extends and a rearward aperture from which a cable of the USB connector plug extends. The housing may also define a cable holder part.

The body has an outer form, which defines on a first surface thereof, a thumb pad and on a second opposing surface, a finger pad. The thumb pad is thus, arranged for receipt of the thumb of a user during a 'plugging in' operation, and the finger pad is arranged for receipt of a finger, usually an index finger, of a user during a 'plugging in' operation. In embodiments, the thumb pad defines a flat profile. In other embodiments, the thumb pad defines a concave dish profile, which in aspects, is generally arranged to mirror the forward profile of a user's thumb. In embodiments, the concave dish profile of the thumb pad defines a rim such as a flat outer rim. In embodiments, the finger pad defines a curved profile such as a concave profile. In embodiments, the finger pad defines a concave tunnel profile, which in aspects, is generally arranged to mirror the longitudinal underside profile of a user's index finger. In other embodiments, the finger pad defines a concave dish profile, which in aspects, is generally arranged to mirror the forward profile of a user's index finger. In embodiments, the concave dish profile of the finger pad defines a rim such as a flat outer rim.

In embodiments, the outer form of the body defines a generally flattened profile. In embodiments, the outer form of the body defines a circular or ovular tablet profile with the thumb pad on a first face of the circular or ovular tablet profile and the finger pad on a second face of the circular or ovular tablet profile.

The outer form of the body is provided with a thumb push element. The thumb push element is arranged for pushing action of the thumb of a user (i.e. for receipt of push force from the thumb of a user) during a 'plugging in' operation. The thumb push element stands proud (i.e. extends in upstanding fashion) from the thumb pad and locates at a forward part thereof. In embodiments, the thumb push element locates at the forward-most part of the thumb pad. In embodiments, the thumb push element defines part of the forward-most end (e.g. end wall) of the housing from which the head of the USB connector plug extends. In embodiments, where the thumb pad defines a concave dish profile, the thumb push element locates at a forward part of the circumference thereof.

In embodiments, the thumb push element has a ramp form, wherein the ramp extends rearward such as to define a ramped pushing surface for the thumb of a user. In embodiments, the ramp defines an angle of between 30° and 60°, preferably between 40° and 50° (e.g. 45°) to the thumb pad. In embodiments, the ramp has a rounded top (i.e. summit) profile. In embodiments, the thumb push element is of rigid construction. In other embodiments, the thumb push element stands proud at a 90° angle to the thumb pad, and in embodiments has a rounded top profile.

In embodiments, the thumb push element has a ramp form and the ramp form thumb push element locates at the forward-most part of the thumb pad. In embodiments, the ramp form thumb push element defines part of the forward-most end (e.g. end wall) of the housing from which the head of the USB connector plug extends. In embodiments, the top (i.e. summit) of the ramp meets directly with the end wall of the housing from which the head of the USB connector plug extends. In embodiments, the ramp form thumb push element has a rounded top profile.

In embodiments, the housing is comprised of a plastic polymer material such as a thermoplastic polymer material such as a thermoplastic polyamide material. In embodiments, the housing is of moulded form. In embodiments, the housing is comprised of a material that is of resilient character.

In embodiments, the housing and USB connector plug are supplied as an integral part (i.e. USB connector plug with housing).

Thus, according to another aspect of the present invention there is provided a housed USB connector plug comprising a USB connector plug defining a plug head and provided with a cable;

a body for partly surrounding said USB connector plug, said body defining a forward aperture from which said plug head of the USB connector plug extends and a rearward aperture from which said cable of the USB connector plug extends, the body having an outer form, which defines on a first surface thereof, a thumb pad and on a second opposing surface, a finger pad, wherein said outer form of the body is provided with a thumb push element that stands proud from a forward part of said thumb pad.

In other embodiments, the housing and connector plug are supplied as a kit of parts for assembly.

In other embodiments, the housing is supplied as an over-housing (e.g. of slip-on form) for a USB connector plug having a housing of the conventional flattened, rectangular form. In such embodiments, the rearward aperture of the body is sized and shaped for receipt of the flattened, rectangular form of the conventional USB housing body. In these embodiments, the cavity defined by the body of the over-housing is also generally sized and shaped for receipt of the flattened, rectangular housing form of the conventional USB connector plug. In these embodiments, the body of the housing thus, acts to 'sleeve' the conventional USB housing body.

BRIEF DESCRIPTION OF THE SEVERAL VIEWS OF THE DRAWINGS

The disclosure is further described with reference to the accompanying drawings, in which.

DETAILED DESCRIPTION OF THE INVENTION

Figure 1A:
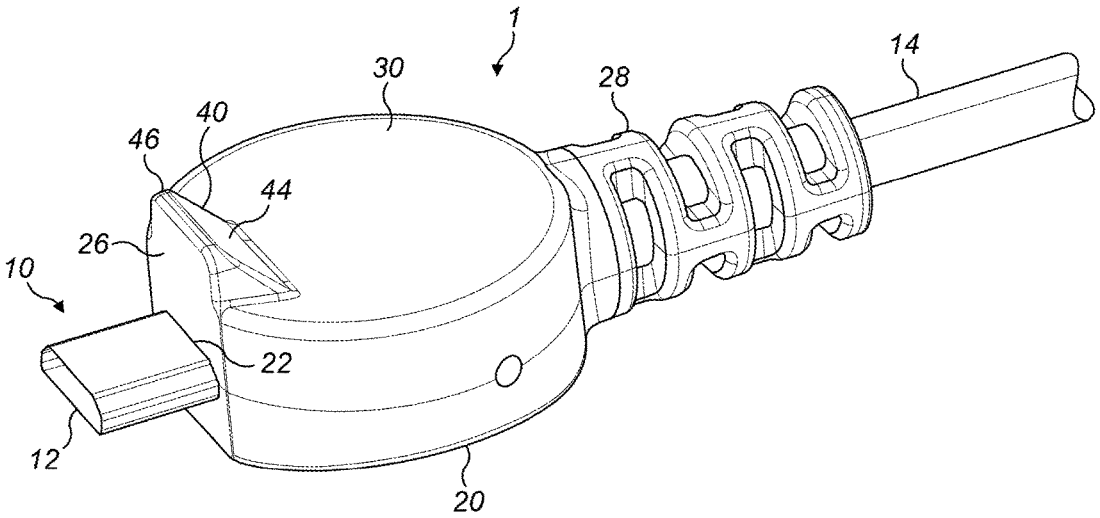
FIGS. 1*a* and 1*b* are perspective views rotated by 90° with respect to each other of a USB connector plug with housing, which is a first embodiment of the invention herein.
Figure 1B:
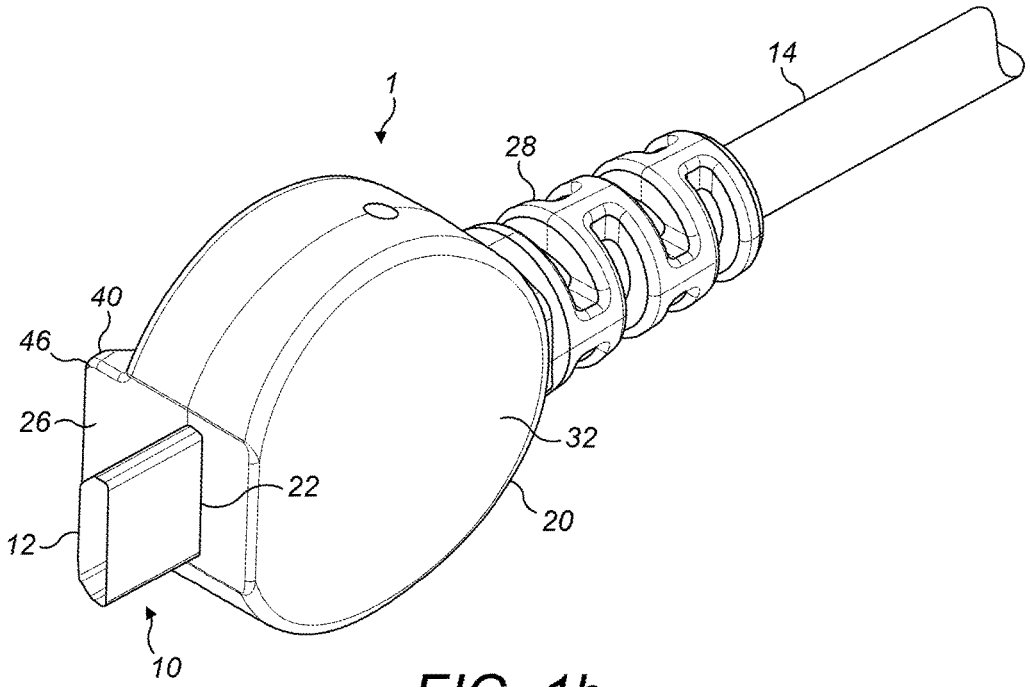
Figure 2A:
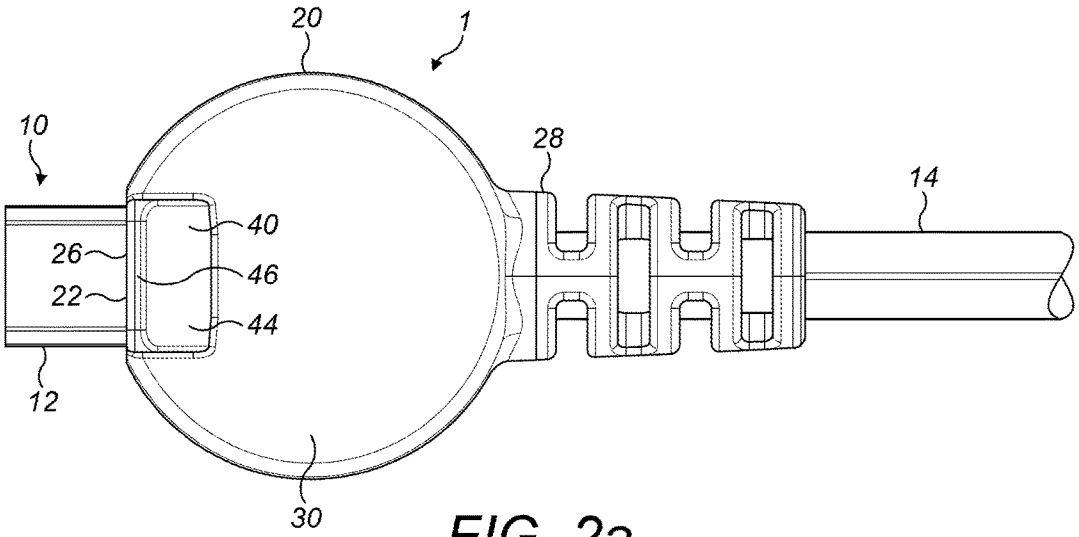
FIGS. 2*a* and 2*b* are respectively top and bottom plan views of the USB connector plug with housing of FIGS. 1*a* and 1*b;*
Figure 2B:
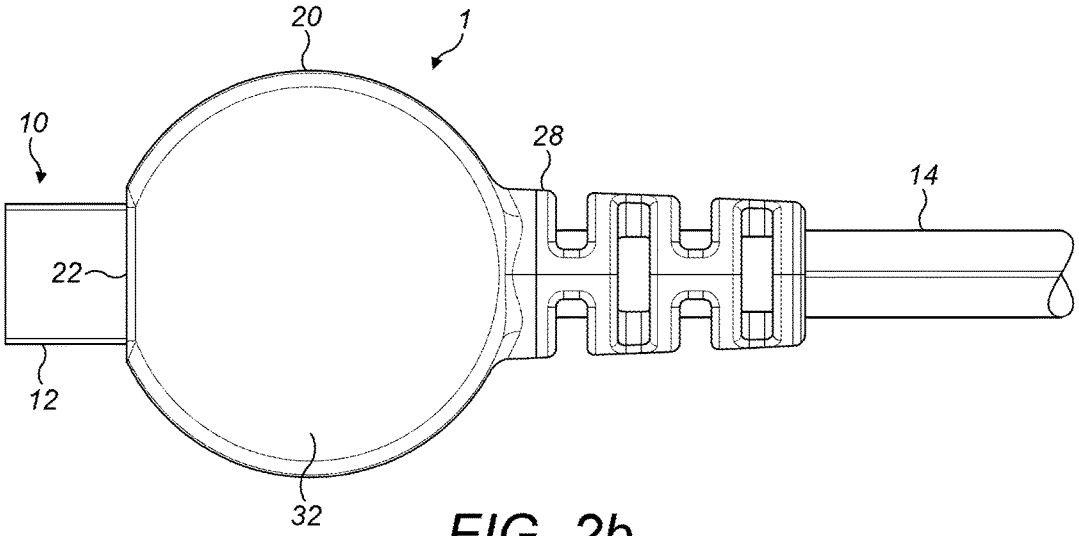
Figure 3:
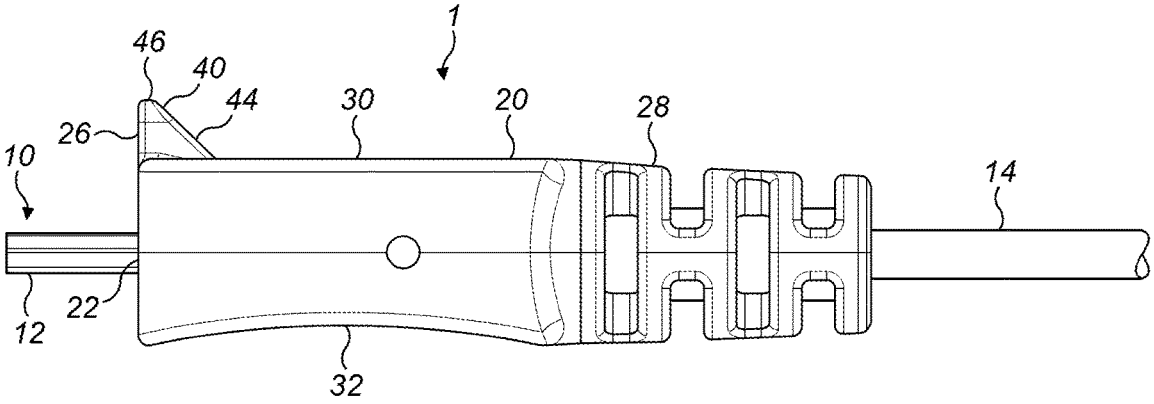
FIG. 3 is a side view of the USB connector plug with housing of FIGS. 1*a* and 1*b;*
Figure 4A:
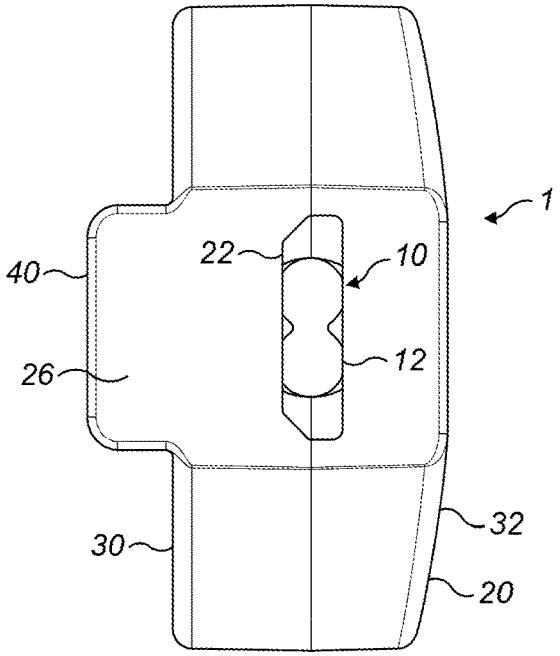
FIGS. 4*a* and 4*b* are respectively forward and rear plan views of the USB connector plug with housing of FIGS. 1*a* and 1*b;*
Figure 4B:
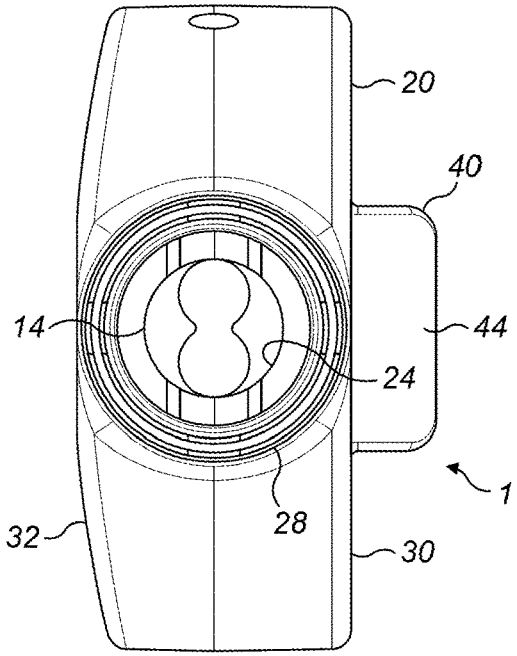

To provide an overall understanding of the systems, devices and methods described herein, certain illustrative embodiments will now be described. For the purpose of clarity and illustration these systems and methods will be described with respect to USB connector plugs that are arranged to be received at a socket of an electronic device. It will be understood by one of ordinary skill in the art that the systems, devices and methods described herein may be adapted and modified as is appropriate, and that these systems, devices and methods may be employed in other suitable applications, and that other such additions and modifications will not depart from the scope hereof.

Referring now to the drawings, FIGS. 1*a* to 4*b* show views of first USB connector plug with housing 1, herein. The USB connector plug 10 defines a plug head 12, which has a form in accord with the USB industry standard, and is provided with a cable 14. The USB connector plug 10 may be of any standard size, but in one embodiment is a micro USB connector plug. The housing 1 comprises a body 20 for partly surrounding the USB connector plug 10. The body defines a generally rectangular-shaped forward aperture 22 from which the plug head 12 of the USB connector plug 10 extends and a rearward aperture 24 (see FIG. 4*b*) from which the cable 14 of the USB connector plug extends. The cable 14 is held by cable holder 28 (sometimes referred to as a 'cable strain relief detail') part of the housing 20.

The body 20 has an outer form of circular tablet profile, which defines on a first surface thereof, a thumb pad 30 and on a second opposing surface, a finger pad 32. The thumb pad 30 defines a concave dish profile for receipt of a forward ('thumb pressing' or 'ball') aspect of a user's thumb. The finger pad 32 defines a concave tunnel profile for receipt of a longitudinal underside profile of a user's index finger. In other embodiments (not shown), the finger pad 32 defines a concave dish profile for receipt of a forward ('index finger pressing' or 'ball') aspect of a user's index finger. Overall, the body 20 is thus, held in a 'pinch grip'. The outer form of the body 20 is provided with a thumb push element 40 that locates at a forward-most part of the thumb pad 30, and generally on the circumference of the concave dish profile thereof, such that the thumb push element 40 defines part of the forward-most end wall 26 of the housing 20 from which the plug head 12 of the USB connector plug 10 extends.

The thumb push element 40 stands proud from the thumb pad 30. The thumb push element 40 has the form of a ramp, which defines a ramped pushing surface 44 for the thumb of a user. The ramp defines an angle of about 45° to the thumb pad. The top 46 of the ramp 44 meets directly with the end wall 26 of the housing 20 from which the plug head 12 of the USB connector plug 10 extends. In embodiments, the top 46 of the ramped thumb push element 40 has a rounded profile.

Figure 5A:
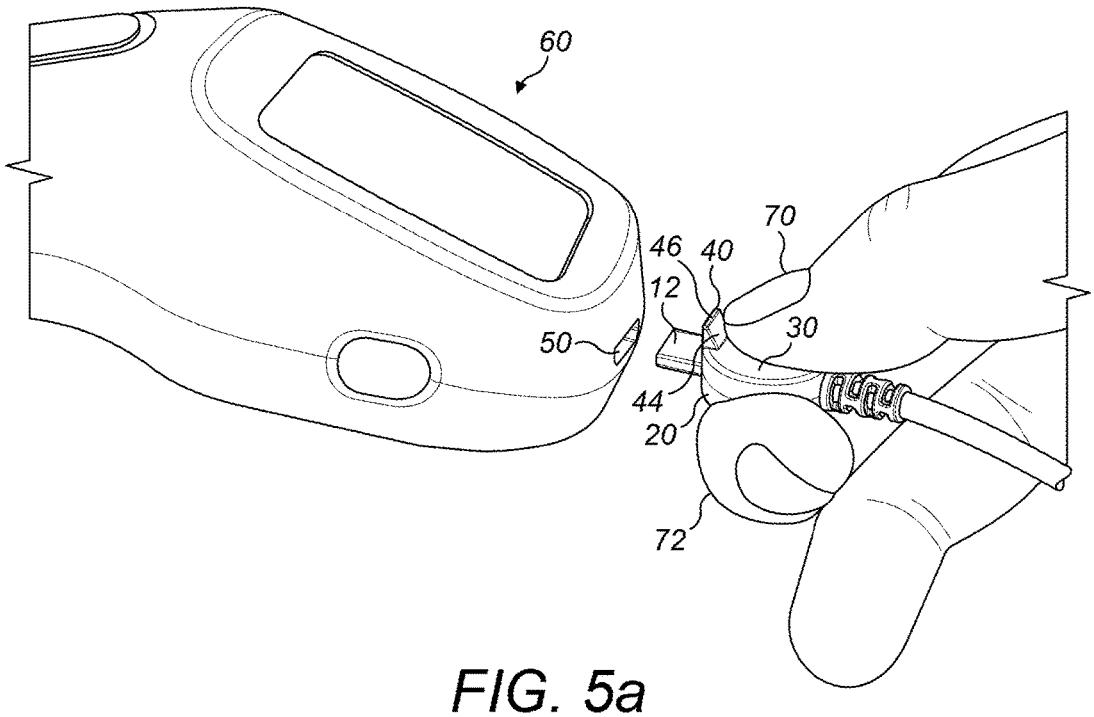
FIGS. 5*a* to 5*c* show sequential steps in a 'plugging in' operation when the USB connector plug with housing of FIGS. 1*a* and 1*b* is plugged into the USB socket of an electronic medical device by action of the thumb and fingers of a user.
Figure 5B:
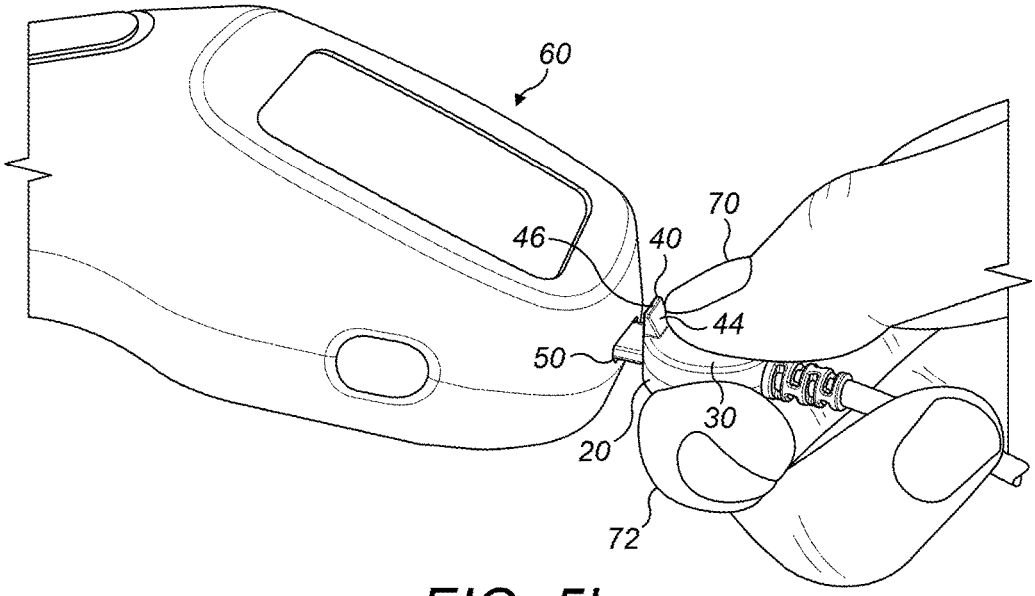
Figure 5C:
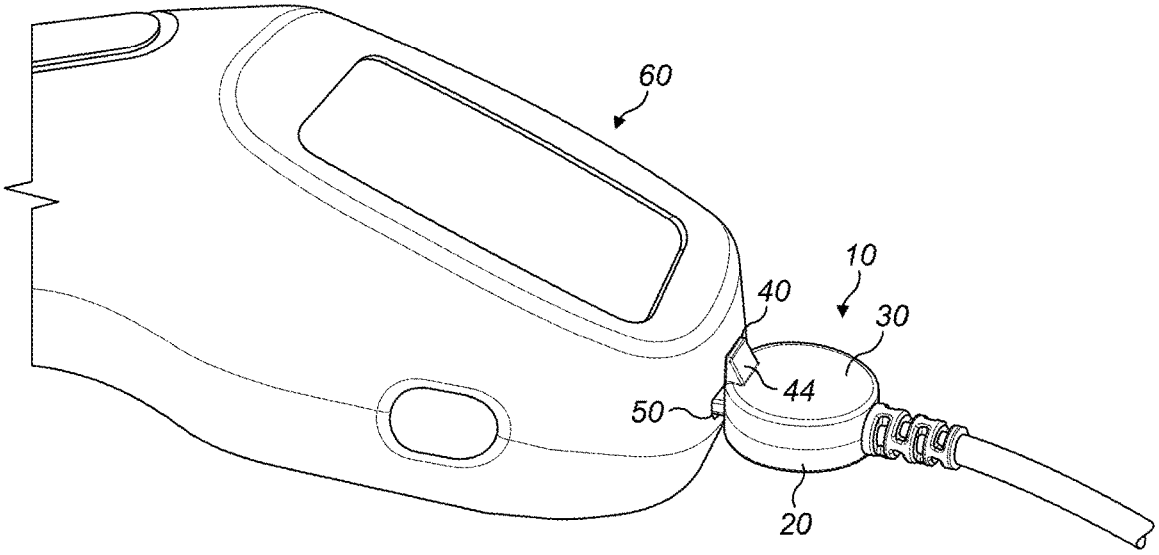

FIGS. 5*a* to 5*c* show sequential steps in a 'plugging in' operation when the USB connector plug with housing 1 as shown at FIGS. 1*a* to 4*b* is plugged into the USB socket 50 of an electronic medical device 60 by action of the thumb 70 and index finger 72 of a user. As shown, the electronic medical device 60 is an electronic auto-injector device, which has data input and retrieval capability and power charging enabled via the USB socket 50 connection.

FIG. 5*a* shows a first step in the 'plugging in' operation. The user grips the circular tablet form body 20 by a gripping action in which the forward pressing part of user's thumb 70 locates at concave dish profile of thumb pad 30 and the longitudinal underside part of user's index finger 72 locates at concave tunnel profile of finger pad 32 (not visible, but see earlier figures). The concave dish profile of the thumb pad 30 assists with location and receipt of the forward pressing part of user's thumb 70 on the thumb pad 30. The concave tunnel profile of the finger pad 32 assists with location and receipt of the longitudinal underside part of user's index finger 72 on the finger pad 32. Forward-most part of the user's thumb 70 comfortably rests up against the ramped pushing surface 44 of the thumb push element 40. The user guides the body 20 to bring the plug head 12 of the USB connector plug 10 into registration with the socket 50 of the medical device 60.

FIG. 5*b* shows a second step in the 'plugging in' operation, in which the plug head 12 of the USB connector plug 10 is being inserted into the socket 50. The insertion is enabled/guided by pushing force provided by the forward pressing part of user's thumb 72 to the ramped pushing surface 44 of the thumb push element 40. Action of the longitudinal underside part of user's index finger 70 at the concave tunnel profiled finger pad 32 also allows for guided insertion.

It will be noted from FIGS. 5*a* and 5*b* that ease of location of the plug head 12 with the socket 10 is assisted because the ramp form thumb push element 40, 44 defines part of the forward-most end wall 26 of the housing 20 from which the plug head 12 of the USB connector plug 10 extends. Similarly, such ease of location is assisted because the rounded top 46 of the ramp 44 meets directly with the end wall 26 of the housing 20 from which the plug head 12 of the USB connector plug 10 extends.

FIG. 5*c* shows the final stage of the 'plugging in' operation, in which the plug head 12 of the USB connector plug 10 is fully received within the socket 50 of the medical device 60. Data transfer and power charging operations may now be carried out.

Figure 6:
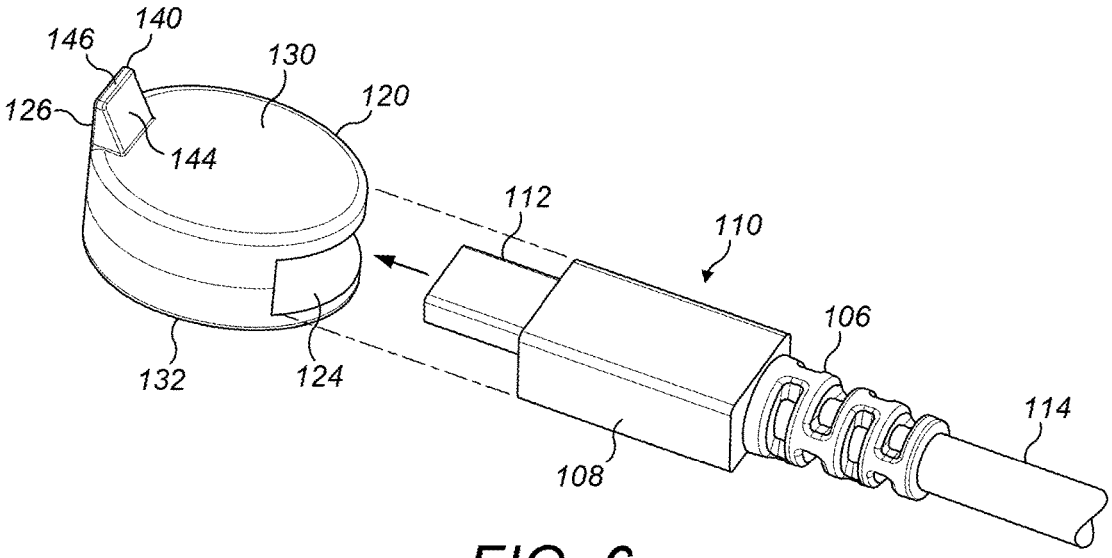
FIG. 6 is a perspective view of a USB connector plug over-housing, which is a second embodiment of the invention herein, and shown receiving a conventionally housed USB connector plug.
Figure 7:
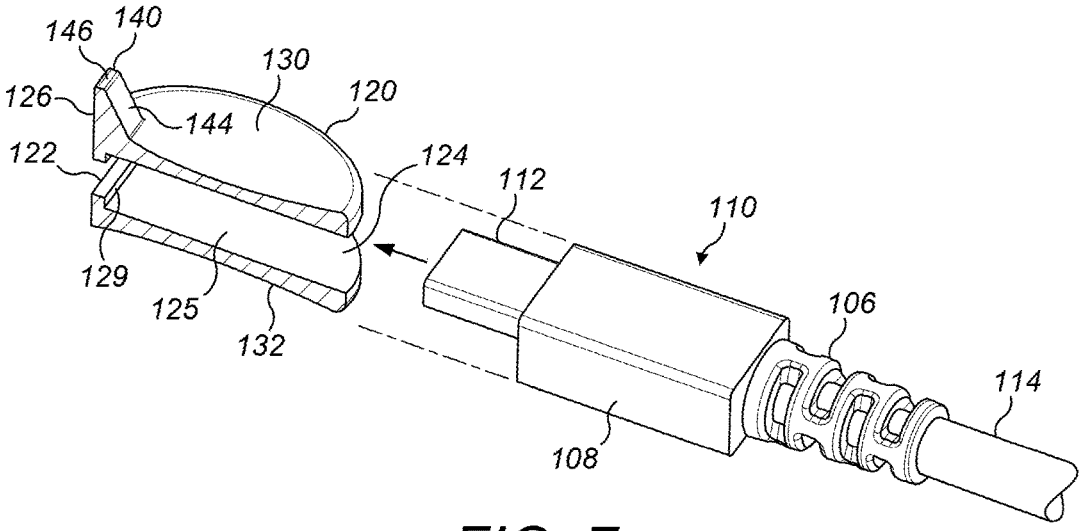
FIG. 7 is a cut away view of the USB connector plug over-housing of FIG. 6 and shown receiving a conventionally housed USB connector plug shown in perspective view.

FIGS. 6 and 7 show views of a USB connector plug over-housing 120 herein that is arranged for over-housed (e.g. 'sleeved') receipt of a conventional USB connector plug 110. The conventional USB connector plug 110 has a flattened, rectangular form housing 108 from which, at the forward end, plug head 112 extends, and also from which, at the rear end, cable 114 extends, partly surrounded by cable holder 106. The USB connector plug 110 may be of any standard size, but in one embodiment is a micro USB connector plug.

The body 120 of the over-housing defines a forward aperture 122 from which the plug head 112 of the conventional USB connector plug 110 extends when in the over-housed/sleeved configuration and a rearward aperture 124 that is sized and shaped for receipt of the flattened, rectangular housing form 108 of the conventional USB connector plug 110. The cavity 125 defined by the body 120 of the over-housing is also sized and shaped for receipt of the flattened, rectangular housing form 108 of the conventional USB connector plug 110. Forward end wall 129 of the cavity defines a stop, which determines the final (e.g. 'sleeved') position of the USB connector plug 110 on receipt within the over-housing body 120.

The body 120 has an outer form of circular tablet profile, which defines on a first surface thereof, a thumb pad 130 and on a second opposing surface, a finger pad 132. The thumb pad 130 defines a concave dish profile for receipt of forward pressing part of a user's thumb. The finger pad 132 defines a concave tunnel profile for receipt of longitudinal underside part of a user's index finger. In other embodiments (not shown), the finger pad 132 defines a concave dish profile for receipt of a forward ('index finger pressing' or 'ball') aspect of a user's index finger. Overall, the body 120 is thus, held in a 'pinch grip'. The outer form of the body 120 is provided with a thumb push element 140 that locates at a forward-most part of the thumb pad 130 such that the thumb push element 140 defines part of the forward-most end wall 126 of the housing 120 from which the plug head 112 of the conventional USB connector plug 110 extends.

The thumb push element 140 stands proud from the thumb pad 130. The thumb push element 140 has the form of a ramp, which defines a ramped pushing surface 144 for the thumb of a user. The ramp defines an angle of about 60° to the thumb pad. As shown, the ramped thumb push element 140 has a square cut upper profile 146. In other embodiments, the ramped thumb push element 140 has a rounded upper profile (e.g. as per the embodiment of FIGS. 1*a* to 4*b*).

It will be appreciated that once the conventional USB connector plug 110 is received within the over-housing 120, the overall form of the 'over-housed' (e.g. 'sleeved') assembly corresponds near identically to that of the first USB connector plug with housing 1 of FIGS. 1*a* to 4*b*. It will also be appreciated that 'plugging in' operation of the 'over-housed' assembly also corresponds to that of the first USB connector plug with housing 1, as described at FIGS. 5*a* to 5*c*.

It is to be understood that the foregoing description is merely illustrative and is not to be limited to the details given herein. While several embodiments have been provided in the present disclosure, it should be understood that the disclosed systems, devices, and methods, and their components, may be embodied in many other specific forms without departing from the scope of the disclosure.

Variations and modifications will occur to those of skill in the art after reviewing this disclosure. The disclosed features may be implemented, in any combination and subcombinations (including multiple dependent combinations and subcombinations), with one or more other features described herein. The various features described or illustrated above, including any components thereof, may be combined or integrated in other systems. Moreover, certain features may be omitted or not implemented. Examples of changes, substitutions, and alterations are ascertainable by one skilled in the art and could be made without departing from the scope of the information disclosed herein. All references cited herein are incorporated by reference in their entirety and made part of this application.

The application of which this description and claims form part may be used as a basis for priority in respect of any subsequent application. The claims of such subsequent application may be directed to any feature or combination of features described herein. They may take the form of product, method or use claims and may include, by way of example and without limitation, one or more of the following claims.

The invention claimed is:

1. A housing for a USB connector plug comprising a body for partly surrounding said USB connector plug, said body defining a forward aperture from which a plug head of the USB connector plug extends and a rearward aperture from which a cable of the USB connector plug extends, the body having an outer form, which defines on a first surface thereof, a thumb pad and on a second opposing surface, a finger pad, wherein said outer form of the body is provided with a thumb push element that stands proud from a forward part of said thumb pad, wherein the outer form of the body defines a circular or ovular tablet profile with the thumb pad on a first face of the circular or ovular tablet profile and the finger pad on a second opposing face of the circular or ovular tablet profile, and wherein the thumb pad defines a concave dish profile and the finger pad defines a concave tunnel profile.

2. The housing according to claim 1, wherein the thumb pad is provided with a flat rim.

3. The housing according to claim 1, wherein the finger pad is provided with a flat rim.

4. The housing according to claim 1, wherein said thumb push element locates at the forward-most part of the thumb pad.

5. The housing according to claim 4, wherein the thumb push element defines part of the forward-most end of the housing from which the plug head of the USB connector plug extends.

6. The housing according to claim 1, wherein the thumb push element has the form of a ramp.

7. The housing according to claim 6, wherein, wherein the ramp defines an angle of between 30° and 60° to the thumb pad.

8. The housing according to claim 6, wherein the top of the ramp meets directly with the end wall of the housing from which the plug head of the USB connector plug extends.

9. The housing according to claim 6, wherein the ramp form thumb push element has a rounded top profile.

10. The housing according to claim 1, wherein the USB connector plug is a micro USB connector plug.

11. The housing according to claim 1, wherein the housing has the form of an over-housing for a USB connector plug having a flattened, rectangular form housing shape, wherein the rearward aperture of the body is sized and shaped for receipt of the flattened, rectangular housing shape.

12. The housing according to claim 11, wherein the over-housing is of slip-on form.

13. A kit of parts comprising the housing according to claim 1 and the USB connector plug.

14. A housed USB connector plug comprising a USB connector plug defining a plug head and provided with a cable;

a body for partly surrounding said USB connector plug, said body defining a forward aperture from which said plug head of the USB connector plug extends and a rearward aperture from which said cable of the USB connector plug extends, the body having an outer form, which defines on a first surface thereof, a thumb pad and on a second opposing surface, a finger pad, wherein said outer form of the body is provided with a thumb push element that stands proud from a forward part of said thumb pad, wherein the outer form of the body defines a circular or ovular tablet profile with the thumb pad on a first face of the circular or ovular tablet profile and the finger pad on a second opposing face of the circular or ovular tablet profile, and wherein the thumb pad defines a concave dish profile and the finger pad defines a concave tunnel profile.

* * * * *